US007773762B2

(12) United States Patent
Akino

(10) Patent No.: US 7,773,762 B2
(45) Date of Patent: Aug. 10, 2010

(54) VARIABLE DIRECTIONAL CONDENSER MICROPHONE UNIT

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 1076 days.

(21) Appl. No.: 11/477,914

(22) Filed: Jun. 30, 2006

(65) Prior Publication Data

US 2008/0002837 A1 Jan. 3, 2008

(51) Int. Cl.
*H04R 25/00* (2006.01)
*H04R 9/08* (2006.01)

(52) U.S. Cl. ..... 381/174; 381/356; 381/361

(58) Field of Classification Search ..... 381/92, 381/174, 175, 356, 361
See application file for complete search history.

*Primary Examiner*—Vivian Chin
*Assistant Examiner*—Friedrich Fahnert
(74) *Attorney, Agent, or Firm*—Manabu Kanesaka

(57) ABSTRACT

To prevent sensitivity from lowering on switching to non-directionality as to a variable directional condenser microphone unit capable of switching to unidirectionality or non-directionality by opening and closing a rear acoustic terminal of a unidirectional condenser microphone unit. The variable directional condenser microphone unit has a converter 20 consisting of a diaphragm 21 set up on a supporter ring 22 and a fixed pole 23 supported by a seat 24 oppositely placed via a spacer housed in a cylindrical housing 10 including a front acoustic terminal 11, the microphone unit being unidirectional in the case where a rear acoustic terminal 24*a* provided on the seat 24 is open and being switchable to non-directionality by blocking the rear acoustic terminal 24*a*, wherein an air chamber A1 for complementing non-directional components is provided on the rear acoustic terminal 24*a* side.

4 Claims, 3 Drawing Sheets

VARIABLE DIRECTIONAL CONDENSER MICROPHONE UNIT

TECHNICAL FIELD

The present invention relates to a variable directional condenser microphone unit switchable between unidirectionality and non-directionality, and in particular, to the variable directional condenser microphone unit of which sensitivity does not change on switching the directionality.

BACKGROUND ART

There are the cases where it is desirable to switch between unidirectionality and non-directionality depending on sound pickup situation. To be more specific, the unidirectionality is desirable in the case where there is a sound other than the sound to be picked up or in the case of amplification use. As opposed to this, the non-directionality is desirable in the case where there is no sound other than the sound to be picked up in a studio or in the case where there is no need for amplification for instance.

For that purpose, two microphones of unidirectionality and non-directionality should be prepared to use one of them according to the sound pickup situation. However, it is not desirable to do so in terms of cost and carrying. There are also the microphones of which unit portions are replaceable. However, replacement thereof takes time and besides, there are the cases where a contact and the like become damaged while repeating the replacement.

On the other hand, it is possible to switch the unidirectionality to the non-directionality by blocking a rear acoustic terminal of a unidirectional condenser microphone unit. A conventional example thereof will be described by using FIG. 4. FIG. 4A is a front view of the unidirectional condenser microphone unit, FIG. 4B is a sectional view thereof, and FIG. 4C is a sectional view in the case of the non-directionality.

With reference to FIGS. 4A and 4B, the unidirectional condenser microphone unit includes a cylindrical housing 10 having a front acoustic terminal 11 on one end face side of a side directed to a sound source. The housing 10 has a converter 20 for converting a sound wave to an electrical signal according to change in capacitance housed therein.

The converter 20 is configured by oppositely combining a diaphragm 21 set up on a supporter ring 22 with a fixed pole 23 supported by an electrical insulating seat 24 via a spacer not shown. The converter 20 is fixed in the housing 10 by a lock ring 26 for instance.

The seat 24 is provided with an electrode drawing rod 25 connected to the fixed pole 23 via an electric conductor not shown. When this unit is mounted on a microphone body not shown, the electrode drawing rod 25 is connected to a gate of an FET which is an impedance converter provided to the microphone body.

To let the sound wave coming around a back of the housing 10 act on a back face of the diaphragm 21, the fixed pole 23 has a large number of sound passage holes 23*a* provided thereon, and the seat 24 has a rear acoustic terminal 24*a* provided thereon.

Thus, the sound wave from the front acoustic terminal 11 acts on the front face of the diaphragm 21 while the sound wave from the rear acoustic terminal 24*a* acts on the back face of the diaphragm 21. Therefore, the condenser microphone unit operates as unidirectional. As shown in FIG. 4C, however, it is rendered non-directional by blocking the rear acoustic terminal 24*a* with a seal plate 27 for instance.

FIG. 5 shows a frequency response characteristic in the case of unidirectionality, and FIG. 6 shows the frequency response characteristic in the case of non-directionality. As for the unidirectional condenser microphone unit, capacity of its internal air chamber is in proportion to sensitivity of non-directional components. For that reason, if the rear acoustic terminal 24*a* is merely blocked as shown in FIG. 4C, the sensitivity is lowered and a frequency response deteriorates as a bidirectional component is no longer taken in. If FIGS. 5 and 6 are compared, the sensitivity is lower by approximately 6 dB and the frequency response is inferior in the case of the non-directionality in comparison with the unidirectionality.

SUMMARY OF THE INVENTION

Thus, an object of the present invention is to prevent the sensitivity from lowering on switching to non-directionality as to a variable directional condenser microphone unit capable of switching between unidirectionality and non-directionality by opening and closing a rear acoustic terminal of a unidirectional condenser microphone unit.

To achieve the above object, the present invention is a variable directional condenser microphone unit having a converter consisting of a diaphragm set up on a supporter ring and a fixed pole supported by an electrical insulating seat oppositely placed via a spacer housed in a cylindrical housing including a front acoustic terminal, the microphone unit being unidirectional in the case where a rear acoustic terminal provided on the seat is open and being switchable to non-directionality by blocking the rear acoustic terminal, wherein an air chamber for complementing non-directional components is provided on the rear acoustic terminal side.

According to this, as for the variable directional condenser microphone unit which is unidirectional in the case where the rear acoustic terminal is open and is switchable to the non-directionality by blocking the rear acoustic terminal, it is possible to provide the variable directional condenser microphone unit of which sensitivity does not change on switching the directionality by providing the air chamber for complementing non-directional components on the rear acoustic terminal.

The present invention is the variable directional condenser microphone unit, wherein the air chamber is formed by a cover member mounted on a back face side of the seat; and the cover member has an opening opened and closed by a shutter.

According to this, it is possible to switch the directionality easily without change in the sensitivity just by opening and closing the opening with a shutter.

The present invention is the variable directional condenser microphone unit, wherein the air chamber is formed by the cover member mounted on the back face side of the seat; and the cover member is removable.

According to this, it is possible to switch the directionality easily without change in the sensitivity just by mounting and removing the cover member.

The present invention is the variable directional condenser microphone unit, wherein capacity of the air chamber is approximately the same as the capacity of a backside including a rear air chamber between the fixed pole and the seat.

According to this, it is possible to have almost no change in the sensitivity on switching the directionality and reduce deterioration of a frequency response.

DETAILED DESCRIPTION

Figure 1A:
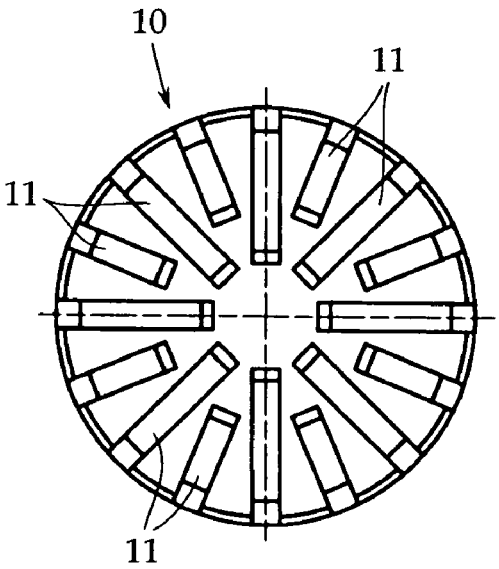
FIG. 1A is a front view of a variable directional condenser microphone unit according to an embodiment of the present invention.
Figure 1B:
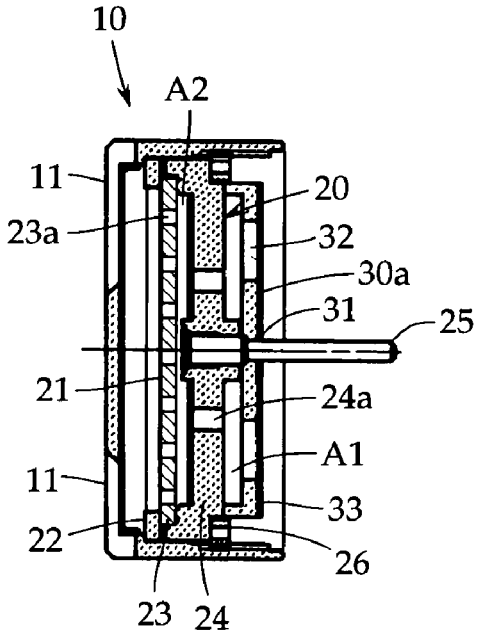
FIG. 1B is a longitudinal sectional view of FIG. 1A.
Figure 2:
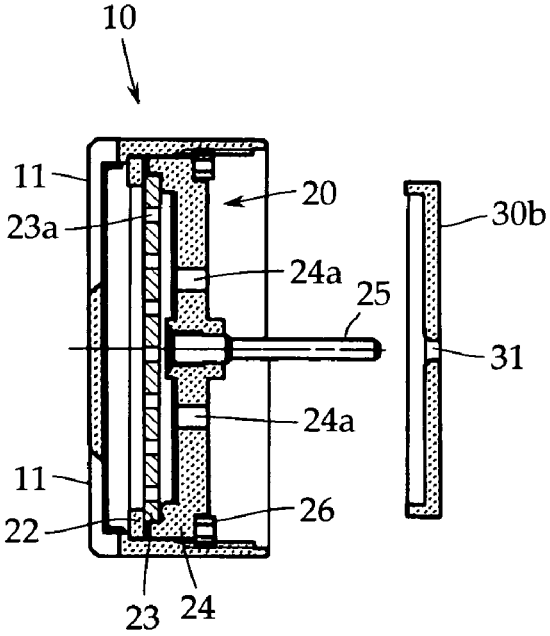
FIG. 2 is a sectional view of the variable directional condenser microphone unit according to another embodiment of the present invention.
Figure 3:
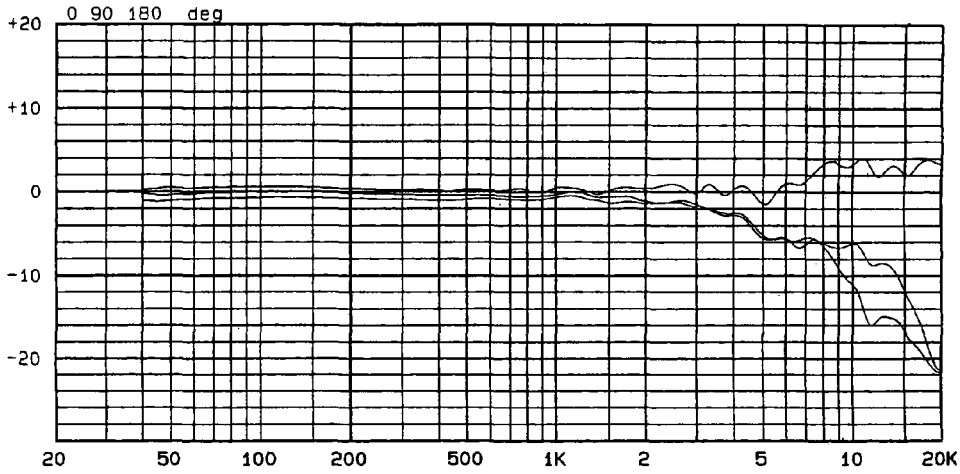
FIG. 3 is a graph showing a frequency response characteristic of the variable directional condenser microphone unit according to the embodiment of the present invention.
Figure 4A:
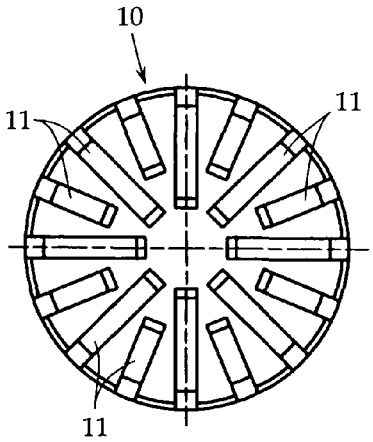
FIG. 4A PRIOR ART
FIG. 4A is a front view of a unidirectional condenser microphone unit.
Figure 4B:
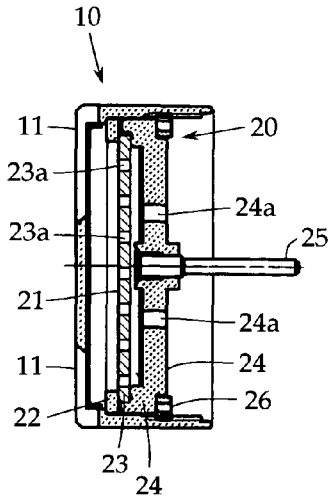
FIG. 4B PRIOR ART
FIG. 4B is a central longitudinal sectional view of FIG. 4A.
Figure 4C:
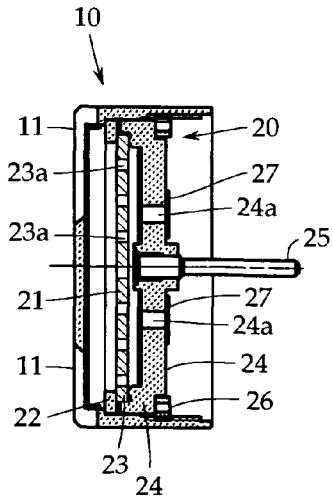
FIG. 4C PRIOR ART
FIG. 4C is a central longitudinal sectional view in the case of non-directionality.

Next, an embodiment of the present invention will be described by using FIGS. 1 to 3. However, the present invention is not limited thereto. FIG. 1A is a front view of a variable directional condenser microphone unit according to an embodiment of the present invention, FIG. 1B is a longitudinal sectional view of FIG. 1A, FIG. 2 is a sectional view of the variable directional condenser microphone unit according to another embodiment of the present invention, and FIG. 3 is a graph showing a frequency response characteristic in the case of non-directionality. The same reference numerals are used as to components which are or can be regarded as the same as the conventional example already described in FIG. 4.

With reference to FIGS. 1A and 1B, the variable directional condenser microphone unit is basically a unidirectional condenser microphone unit. To be more specific, it includes a cylindrical housing 10 having a front acoustic terminal 11 on one end face side of a side directed to a sound source. The housing 10 has a converter 20 for converting a sound wave to an electrical signal according to change in capacitance housed therein.

According to this embodiment, the converter 20 is configured by oppositely combining a diaphragm 21 set up on a supporter ring 22 with a fixed pole 23 supported by an electrical insulating seat 24 via a spacer not shown. The converter 20 is fixed in the housing 10 by a lock ring 26 for instance. The converter 20 may also be fixed by caulking on a posterior edge of the housing 10.

The seat 24 is provided with an electrode drawing rod 25 connected to the fixed pole 23 via an electric conductor not shown. When this unit is mounted on a microphone body not shown, the electrode drawing rod 25 is connected to a gate of an FET which is an impedance converter provided to the microphone body.

To let the sound wave coming around the back of the housing 10 act on a back face of the diaphragm 21, the fixed pole 23 has a large number of sound passage holes 23*a* provided thereon, and the seat 24 has a rear acoustic terminal 24*a* provided thereon.

Thus, the sound wave from the front acoustic terminal 11 acts on the front face of the diaphragm 21 while the sound wave from the rear acoustic terminal 24*a* acts on the back face of the diaphragm 21. Therefore, the condenser microphone unit operates as unidirectional and is rendered non-directional by blocking the rear acoustic terminal 24*a*. To prevent a change in the sensitivity in that case, an air chamber A1 for complementing non-directional components is provided on the rear acoustic terminal 24*a* side according to the present invention.

According to this embodiment, the air chamber A1 is formed by a cover member 30*a* mounted on the back face side of the seat 24. In this case, the cover member 30*a* consists of a dish-like cover forming the air chamber A1 between itself and the back face of the seat 24. However, the air chamber A1 just has to be formed between the back face of the seat 24 and the cover member 30*a*. Therefore, it is also feasible to dent the back face side of the seat 24 as much as capacity of the air chamber A1 and render the cover member 30*a* as a tabular cover.

The cover member 30*a* according to this embodiment has a rod insertion hole 31 for having the electrode drawing rod 25 airtightly inserted into its bottom face (the face opposed to the seat 24), an opening 32 for having the air chamber A1 communicate with air, and also a shutter 33 for selectively opening and closing the opening 32. Size and the number of the openings 32 may be decided arbitrarily.

According to this, the microphone unit becomes unidirectional by opening the opening 32 and becomes non-directional by blocking the opening 32 with the shutter 33. In the case of rendering it non-directional, it is desirable to render the capacity of the air chamber A1 almost the same as unit backside capacity A2 in order to increase the sensitivity for the sake of making up for bidirectional components no longer taken in.

Strictly speaking, the capacity of the air chamber A1 includes the capacity of the opening 32. The unit backside capacity A2 includes the capacity of a rear air chamber between the fixed pole 23 and the seat 24, and also includes the capacity of a thin airspace between the diaphragm 21 and the fixed pole 23, the capacity of the sound passage holes 23*a* provided to the fixed pole 23 and the capacity of the rear acoustic terminal 24*a*.

It is possible to render the opening 32 openable and closable by providing the shutter 33 with an unshown control lever extended to outside the housing 10 so as to switch between unidirectionality and non-directionality by a simple operation. As shown in FIG. 2, it is also possible, as another embodiment, to removably mount a dish-like cover member 30*b* having only the rod insertion hole 31 on its bottom face on the back face of the seat 24.

In either case of the cover member 30*a* or 30*b*, it is desirable to put a sealant such as silicon rubber in between so as to prevent air leakage between itself and the back face of the seat 24.

Figure 5:
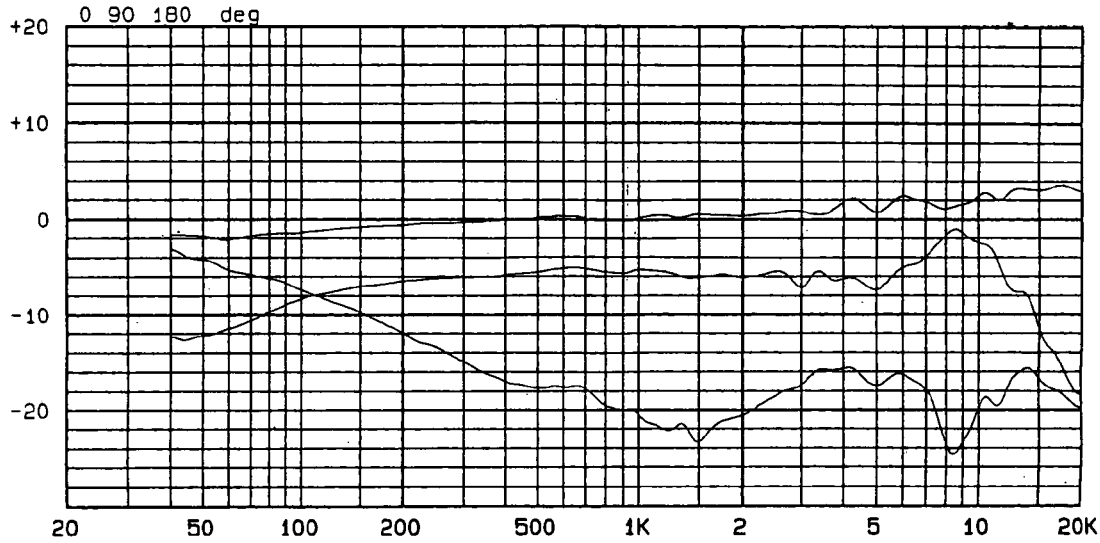
FIG. 5 PRIOR ART
FIG. 5 is a graph showing the frequency response characteristic of unidirectionality.
Figure 6:
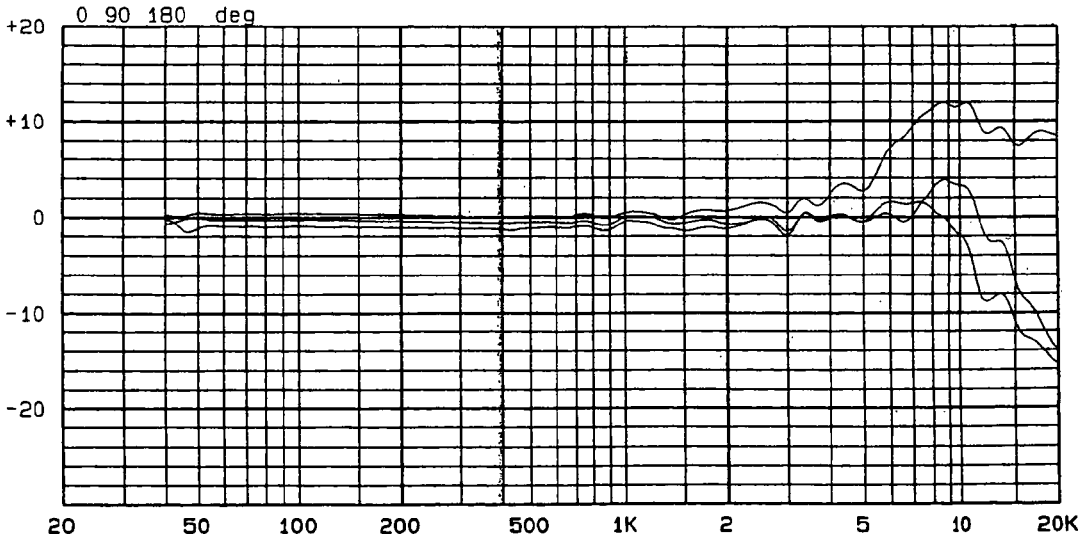
FIG. 6 PRIOR ART
FIG. 6 is a graph showing the frequency response characteristic in the case of the non-directionality of FIG. 4C.

The graph of FIG. 3 shows the frequency response characteristic in the case of rendering the variable directional condenser microphone unit according to the above embodiment non-directional. FIG. 5 should be referred to as to the frequency response characteristic in the case of rendering it unidirectional. According to this, there is little change in the sensitivity between the case of the unidirectionality and the case of the non-directionality. A frequency response is much better than that in the case of the conventional example in FIG. 6.

The present application is based on, and claims priority from, Japanese Application Serial Number JP2005-151905, filed May 25, 2005, the disclosure of which is hereby incorporated by reference herein in its entirety.

The invention claimed is:

1. A variable directional condenser microphone unit having a converter consisting of a diaphragm set up on a supporter ring and a fixed pole supported by an electrical insulating seat oppositely placed via a spacer housed in a cylindrical housing including a front acoustic terminal, the microphone unit being unidirectional in the case where a rear acoustic terminal provided on the seat is open and being switchable to non-directionality by blocking the rear acoustic terminal, wherein an air chamber for complementing non-directional components is provided on the rear acoustic terminal side.

2. The variable directional condenser microphone unit according to claim 1, wherein the air chamber is formed by a cover member mounted on a back face side of the seat; and the cover member has an opening opened and closed by a shutter.

3. The variable directional condenser microphone unit according to claim 1, wherein the air chamber is formed by the cover member mounted on the back face side of the seat; and the cover member is removable.

4. The variable directional condenser microphone unit according to claim 1, wherein capacity of the air chamber is approximately the same as the capacity of a backside including a rear air chamber between the fixed pole and the seat.

* * * * *